US005431857A

United States Patent [19]

Capeci

[11] Patent Number: 5,431,857

[45] Date of Patent: Jul. 11, 1995

[54] PROCESS FOR PRODUCING A HIGH DENSITY DETERGENT COMPOSITION HAVING IMPROVED SOLUBILITY BY AGGLOMERATION OF ANIONIC SURFACTANTS AND AN AGGLOMERATING AGENT

[75] Inventor: Scott W. Capeci, North Bend, Ohio

[73] Assignee: The Proctor & Gamble Company, Cincinnati, Ohio

[21] Appl. No.: 184,625

[22] Filed: Jan. 19, 1994

[51] Int. Cl.[6] ..... C11D 1/12

[52] U.S. Cl. ..... 252/549; 252/550; 252/553; 252/558; 252/174.13

[58] Field of Search ..... 252/135, 174, 174.14, 252/553, 549, 550, 558, 174.13

[56] References Cited

U.S. PATENT DOCUMENTS

| | | | |
|---|---|---|---|
| 3,609,088 | 9/1971 | Sumner | 252/99 |
| 3,625,902 | 12/1971 | Sumner | 252/99 |
| 3,933,670 | 1/1976 | Brill et al. | 252/99 |
| 3,966,629 | 6/1976 | Dumbrell | 252/140 |
| 3,998,762 | 12/1976 | Murata et al. | 252/553 |
| 4,059,538 | 11/1977 | Green et al. | 252/95 |
| 4,096,081 | 6/1978 | Phenicie et al. | 252/89 R |
| 4,169,806 | 10/1979 | Davis et al. | 252/99 |
| 4,170,565 | 10/1979 | Flesher et al. | 252/93 |
| 4,207,197 | 6/1980 | Davis et al. | 252/99 |
| 4,228,025 | 10/1980 | Jacobsen | 252/99 |
| 4,427,417 | 12/1984 | Porasik | 23/313 R |
| 4,487,710 | 12/1984 | Kaminsky | 252/546 |
| 4,925,585 | 5/1990 | Strauss et al. | 252/174 |
| 5,108,646 | 4/1992 | Beerse et al. | 252/174.25 |
| 5,160,657 | 11/1992 | Bortolotti et al. | 252/174 |
| 5,178,798 | 1/1993 | Jolicoeur | 252/174 |

FOREIGN PATENT DOCUMENTS

| | | | |
|---|---|---|---|
| 1517713 | 7/1978 | United Kingdom | C11D 17/06 |

*Primary Examiner*—Hoa V. Le

*Attorney, Agent, or Firm*—Ken K. Patel; Jacobus C. Rasser; Jerry J. Yetter

[57] ABSTRACT

A process for producing a high density detergent composition having a density of about 650 g/l is provided. The process comprises the step of forming detergent agglomerates by feeding several streams of materials into a mixer/densfier. Specifically, the following materials are continuously fed into the mixer/densifier: (i) from about 1% to about 50% by weight of a $C_{10-18}$ linear alkylbenzene sulfonate surfactant; (ii) from about 1% to about 50% by weight of a $C_{12-16}$ alkyl sulfate surfactant, wherein the linear alkylbenzene sulfonate and the alkyl sulfate are in the form of dry particles; (iii) from about 20% to about 50% by weight of a builder; and (iv) from about 0.1% to about 35% by weight of an agglomerating agent which substantially prevents the intimate mixing of the linear alkylbenzene sulfonate surfactant and the alkyl sulfate surfactant in the mixer/-densifier. Another step of the process entails drying the detergent agglomerates to form the high density detergent composition having a density of 650 g/l.

4 Claims, No Drawings

PROCESS FOR PRODUCING A HIGH DENSITY DETERGENT COMPOSITION HAVING IMPROVED SOLUBILITY BY AGGLOMERATION OF ANIONIC SURFACTANTS AND AN AGGLOMERATING AGENT

FIELD OF THE INVENTION

The present invention generally relates to a process for producing a high density detergent composition for use in laundering operations. More particularly, the process of the invention produces a detergent composition having a density of at least 650 g/l by agglomerating anionic surfactants with an agglomerating agent which substantially prevents the intimate mixing of the surfactants in the mixer/densifier so as to result in a detergent composition having improved solubility in the washing solution. The process also requires that the anionic surfactants used be in an optimum weight ratio to insure production of the desired high density detergent composition.

BACKGROUND OF THE INVENTION

Typically, granular detergents are made via conventional spray drying techniques which produce spray dried granules having acceptable solubility in the laundering solutions. The acceptable solubility of the spray dried granules is primarily attributed to their high porosity, a feature which is grossly diminished when they are subjected to further processing such as agglomeration, grinding and/or pulverizing. Recently, there has been considerable interest within the detergent industry for laundry detergents which are "compact" and therefore, have low dosage volumes. The low dosage detergents are currently in high demand as they conserve resources and can be sold in small packages which are more convenient for consumers. In that regard, additional processing steps such as grinding and the like have been used to convert the porous spray dried granules into more "compact" granules. However, the resulting "compact" granules commonly do not possess favorable solubility characteristics, especially in low temperature washing solutions. Thus, it would be desirable to have a process which produces a detergent composition having improved solubility in the laundering solution.

More recent process developments relating to compact detergents have been directed to agglomeration techniques. For example, Curtis, European patent application No. 451,894 (Unilever), discloses a process for preparing high density detergent granules by using two mixers in series. In particular, an admix of starting detergent materials are fed into a high speed mixer/densifier after which the materials are fed into a moderate speed mixer/densifier to increase the bulk density further. Thus, Curtis initially requires a high speed mixer/densifier to pulverize the detergent granules and then a second moderate speed mixer/densifier to increase the density to the desired level.

The Curtis process, however, does not produce detergent agglomerates having satisfactory solubility in the laundering solution. The lower solubility characteristics are attributed, in part, to the relatively high levels of anionic surfactants typically contained in the so-called compact or low dosage detergents. Furthermore, compact detergent compositions having high levels of anionics tend to form a sticky gel phase upon contact with the laundering solution, a feature which exacerbates the solubility problem. It would therefore be desirable to have a process which produces a compact or high density detergent composition containing high levels of anionic surfactants and yet, maintains effective solubility in the laundering solution.

Accordingly, despite the aforementioned disclosures in the art, there is a need for a process which produces a high density detergent composition having a high level of anionic surfactant and exhibiting improved solubility in the laundering solution.

SUMMARY OF THE INVENTION

The present invention meets the needs identified above by providing a process which produces a high density detergent composition containing high levels of anionic surfactants yet does not exhibit a tendency to gel or cake upon contact with the laundering solution. In this way, the solubility of the detergent composition in the laundering solution is improved which ultimately enhances cleaning performance. Further, the process produces such a detergent composition in the form of crisp, free flowing detergent agglomerates having a density of about 650 g/l. The process of the invention achieves these desired results, in part, by preventing the intimate mixing of the anionic surfactant prior to agglomerating in the mixer/densifier and by including an agglomerating agent other than the surfactant solution itself. All percentages and ratios referenced herein are "by weight" unless otherwise indicated. All documents referenced herein are incorporated by reference.

In accordance with one aspect of the invention, a process for producing a high density detergent composition having a density of about 650 g/l is provided. The process comprises the step of forming detergent agglomerates by feeding several streams of materials into a mixer/densifier. Specifically, the following materials are continuously fed into the mixer/densifier: (i) from about 1% to about 50% by weight of a $C_{10-18}$ linear alkylbenzene sulfonate surfactant; (ii) from about 1% to about 50% by weight of a $C_{12-16}$ alkyl sulfate surfactant, wherein the linear alkylbenzene sulfonate and the alkyl sulfate are in the form of dry particles; (iii) from about 20% to about 50% by weight of a builder; and (iv) from about 0.1% to about 35% by weight of an agglomerating agent which substantially prevents the intimate mixing of the linear alkylbenzene sulfonate surfactant and the alkyl sulfate surfactant in the mixer/densifier. Another step of the process entails drying the detergent agglomerates to form the high density detergent composition having a density of 650 g/l.

In another aspect of the invention, the process produces a detergent composition having a density of at least 650 g/l in much the same manner as described above but the agglomerating agent is fed along with the $C_{10-18}$ linear alkylbenzene sulfonate surfactant stream and the $C_{12-16}$ alkyl sulfate surfactant steam is maintained in the form of dry particles as it is fed into the mixer/densifier. In this process, the agglomerating agent also prevents the intimate mixing of the linear alkylbenzene sulfonate surfactant and the alkyl sulfate surfactant in the mixer/densifier prior to agglomeration. In yet another similar aspect of the invention, the agglomerating agent is introduced with the $C_{12-16}$ alkyl sulfate surfactant stream or the $C_{10-18}$ linear alkylbenzene sulfonate surfactant stream while the linear alkylbenzene sulfonate surfactant stream is maintained in the form of dry particles.

Another aspect of the invention is directed to a similar process in which both the $C_{10-18}$ linear alkylbenzene sulfonate surfactant stream and the $C_{12-16}$ alkyl sulfate surfactant stream contain an agglomerating agent such as water to substantially prevent the intimate mixing of the two anionic surfactants in the mixer/densifier. In this way, detergent agglomerates having the desired properties are produced.

Accordingly, it is an object of the invention to provide a process which produces a high density detergent composition containing high levels of anionic surfactant yet exhibits improved solubility in the laundering solution. It is also an object of the invention to provide a process which produces such a detergent composition in the form of crisp, free flowing detergent agglomerates having a density of about 650 g/l. These and other objects, features and attendant advantages of the present invention will become apparent to those skilled in the art from a reading of the following detailed description of the preferred embodiment and the appended claims.

DETAILED DESCRIPTION OF THE PREFERRED EMBODIMENTS

The process of the invention produces a high density detergent composition having a density of at least 650 g/l that is used primarily in laundering operations. Generally, the present process is used in the production of low dosage detergents wherein the detergent agglomerates formed by the process can be used as a detergent or as a detergent additive. For example, the process can be used to form "high active" (i.e. high anionic surfactant level) detergent agglomerates which are used as an admix for purposes of enhancing the active levels in granular low dosage detergents and thereby allow for more compact detergents. It should be understood that the process described herein can be continuous or batch depending upon the desired application.

The Process

In the first step of the process, detergent agglomerates are formed in a mixer/densifier, such as a Lodige KM (Ploughshare) mixer or Schugi mixer. This step entails agglomerating several components including but not limited to from about 1% to about 50%, more preferably from about 6% to about 40%, of a $C_{10-18}$ linear alkylbenzene sulfonate surfactant; from about 1% to about 50%, more preferably from about 6% to about 40%, of a $C_{12-16}$ alkyl sulfate surfactant; from about 20% to about 50%, more preferably from about 25% to about 45%, of a builder; and from about 0.1% to about 35%, more preferably from about 2% to about 20%, of an agglomerating agent.

In one embodiment of the invention, the linear alkylbenzene sulfonate and the alkyl sulfate surfactant are in the form of substantially dry particles. The linear alkylbenzene sulfonate dry particles and alkyl sulfate particles are preferably fed into the mixer/densifier in two separate streams so as to prevent any intimate mixing between the two prior to agglomeration in the mixer/densifier. By separating the two input streams of anionic surfactants and incorporating the agglomerating agent into the mixer/densifier, the resulting detergent agglomerates contain discrete portions of each anionic surfactant in each individual particle. In addition to facilitating agglomeration, the agglomerating agent helps prevent intimate mixing of the anionic surfactants prior to, and during transformation into agglomerates. While not intending to be limited by theory, it is believed that this feature i.e., agglomerates having discrete portions of anionic surfactant, of the resulting detergent agglomerates insures against undesirable gelling or caking upon exposure to the laundering solution. As a consequence, the solubility of the detergent agglomerates is improved despite the inclusion of a high level of anionic surfactant.

In another embodiment of the process invention, one of the linear alkylbenzene sulfonate and alkyl sulfate surfactant feed streams into the mixer/densifier is in the form of substantially dry particles while the other is a liquid or paste. Again, the individual surfactant feed streams are kept apart so as to prevent intimate mixing of the anionic surfactants prior to agglomeration. The liquid or paste stream can be aqueous in which case the agglomerating agent is water or it can be based on another agglomerating agent as described hereinafter. Another embodiment of the process invention entails having both surfactant feed streams in the form of a liquid or paste. The anionic surfactant streams are separately fed into the mixer/densifier to avoid intimate contact prior to agglomeration.

For purposes of facilitating the avoidance of intimate mixing of the anionic surfactants used in the present process, the previously mentioned agglomerating agent is added to the mixer. It should be understood, however, that when one or both of the surfactant feed streams are in the form of a liquid or paste, then the liquid media of that particular liquid or paste stream can serve as the agglomerating agent which will typically comprise one or more of the materials described herein as the agglomerating agent. In the embodiment in which both surfactant streams are in the form of dry particles, an agglomerating agent as described herein is preferably also incorporated into the mixer/densifier. Preferably, from about 0.1% to about 35%, more preferably from about 2% to about 20%, of the agglomerating agent is mixed into the mixer in the present process. Further details of the agglomerating agent are described hereinafter. While not intending to be limited by theory, the aforementioned surfactant ratio also facilitates production of more soluble agglomerates in that each individual agglomerate contains an optimum balance of the readily soluble linear alkylbenzene sulfonate surfactant and the lesser soluble alkyl sulfate surfactant.

The process additionally entails mixing from about 20% to about 50%, preferably from about 25% to about 45% of a builder in order to enhance the cleaning performance of the resulting detergent agglomerates. As is well known, detergency builders primarily serve as heavy metal sequestering agents to minimize or eliminate the "hardness" from the laundering solution. Nonlimiting examples of suitable builders for use in the process are presented hereinafter.

The process also includes the step of drying the detergent agglomerates as they exit the mixing/densifier step described above. As those skilled in the art will readily appreciate, a multitude of drying techniques may be implemented in the present process. For example, a conventional fluid bed drying may used to dry the detergent agglomerates. Obviously, the less drying required, the more economical the manufacturing process. To that end, the present process preferably includes the step of using the agglomerating agent as described herein which contains the least amount of volatiles, e.g. water, to the extent possible.

By way of the process according to the invention, a detergent composition with a density of at least 650 g/l which is in the form of crisp, free flowing agglomerates is produced. The mean particle size of the agglomerates in the detergent composition produced by the process is from about 200 microns to about 1000 microns, preferably from about 300 microns to about 700 microns. Importantly, the detergent composition produced by the process does not exhibit a tendency to gel or cake upon contact with aqueous laundering solutions. As a consequence, the solubility of the detergent composition in the laundering solution is improved which ultimately enhances cleaning performance.

The Agglomerating Agent

The agglomerating agent used in the process of the invention can include a single component or a mixture of several components. Preferably, the agglomerating agent is selected from the group consisting of polyethylene glycol, polyethylene oxides, propylene oxides, propylene glycols, water, and mixtures thereof. The agglomerating agent as used herein operates as a binder to aid in the formation of strong, rigid crisp, free flowing agglomerates as opposed to a sticky paste or dough. Further, the agglomerating agent facilitates the avoidance of excessive intimate mixing of the alkyl sulfate surfactant and the linear alkylbenzene sulfonate surfactant, a feature necessary for the process to produce a detergent composition having improved solubility. It has been found that substantial intimate mixing of alkyl sulfate and linear alkylbenzene sulfonate surfactants leads to the formation of agglomerates and/or granules which have poor gelling characteristics which ultimately impede dissolution in the aqueous laundering solutions.

A preferred agglomerating agent consists of a mixture of polyethylene glycol and water in a weight ratio of from about 1:10 to about 10:1. Preferred polyethylene glycols have an average molecular weight of at least about 1000, more preferably from about 2500 to about 20,000, and most preferably from about 3000 to about 10,000.

Other suitable agglomerating agents for use herein include water-soluble polymers containing about 50% by weight of ethylene oxide and having a viscosity of from about 325 cps to about 20,000 cps, preferably from about 375 cps to about 17,000 cps. Such polymers or mixtures thereof generally should have a melting point of not less than about 35° C. Preferably, the polymeric material will have a melting point of not less than about 45° C., more preferably not less than about 55° C. Since the polymeric materials suitable for use herein will typically comprise mixtures representing a range of molecular weights, the materials have a tendency to soften and begin to liquefy over a range of temperatures of from about 3° C. to about 7° C. above their complete melting point. As those skilled in the art will readily appreciate, mixtures of two or more agglomerating agents used herein will have even a wider range.

Additional materials suitable for use as the agglomerating agent include polymers containing at least about 70% ethylene oxide by weight and more preferred polymers contain at least about 80% ethylene oxide by weight. Preferred polymeric materials have HLB values of at least about 15, and more preferably of about 17. As mentioned, polyethylene glycol is especially preferred for use herein which can contain essentially 100% ethylene oxide by weight.

Still other suitable agglomerating agents include polymers which are the condensation products of $C_{10-20}$ alcohols or $C_{8-18}$ alkyl phenols with sufficient ethylene oxide, not less than 50% by weight of the polymer, that the resultant product has a melting point not below about 35° C. Block and heteric polymers based on ethylene oxide and propylene oxide addition to a low molecular weight organic compound containing one or more active hydrogen atoms are also suitable for use herein. Polymers based on the addition of ethylene oxide and propylene oxide to propylene glycol, ethylenediamine, and trimethylopropane are commercially under the trade names Pluronics TM, Pluronics F TM, Tetronics TM, and Pluradots TM all commercially available from BASF Wyandotte Corporation.

Detergent Surfactant

The detergent surfactants used in the process will generally be in the form of a surfactant system including several components. However, the surfactant system in the detergent composition must include alkyl sulfate surfactant and linear alkylbenzene sulfonate surfactant at the levels discussed previously. In preferred embodiments of the invention, the weight ratio of alkyl sulfate to linear alkyl benzene sulfonate is from about 1:10 to about 10:1, most preferably from about 1:4 to about 4:1. In this way, solubility of the detergent composition produced by the present process invention is enhanced. Optionally, the surfactant system may contain one or more of additional surfactants, nonlimiting examples of which are provided hereinafter.

The surfactant system preferably includes conventional primary alkyl sulfate surfactants having the general formula $$ROSO_3{}^-M^+$$

wherein R is typically a linear $C_{10}$–$C_{20}$ hydrocarbyl group and M is a water-solubilizing cation. Branched-chain primary alkyl sulfate surfactants (i.e., branched-chain "PAS") having 10–20 carbon atoms can also be used herein; see, for example, European Patent Application 439,316, Smith et al, filed 21.01.91, the disclosure of which is incorporated herein by reference (Included in the term "alkyl" is the alkyl portion of acyl groups). Also included in the surfactant system is the conventional $C_{11}$–$C_{18}$ alkyl benzene sulfonates (also referenced herein as "LAS). While the biodegradability of the so-called "LAS" surfactants has been the subject of some concern, the surfactant system herein includes an optimum level for improving the solubility of the detergent composition without substantially sacrificing the overall biodegradability.

Adjunct Surfactants

The surfactant can include several additional optional surfactants selected from other anionic, nonionic, zwitterionic, ampholytic and cationic classes and compatible mixtures thereof. Detergent surfactants useful herein are described in U.S. Pat. No. 3,664,961, Norris, issued May 23, 1972, and in U.S. Pat. No. 3,919,678, Laughlin et al., issued Dec. 30, 1975, both of which are incorporated herein by reference. Useful cationic surfactants also include those described in U.S. Pat. No. 4,222,905, Cockrell, issued Sep. 16, 1980, and in U.S. Pat. No. 4,239,659, Murphy, issued Dec. 16, 1980, both of which are also incorporated herein by reference.

Water-soluble salts of the higher fatty acids, i.e., "soaps", are useful anionic surfactants in the compositions herein. This includes alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Other anionic surfactants suitable for use herein are the sodium alkyl glyceryl ether sulfonates, especially those ethers of higher alcohols derived from tallow and coconut oil; sodium coconut oil fatty acid monoglyceride sulfonates and sulfates; sodium or potassium of $C_{10-18}$alkyl ethoxy sulfates wherein the average ethylene oxide per molecule is from 1 to 5, preferably from 1 to 3; and sodium or potassium salts of alkyl ethylene oxide ether sulfates containing about 1 to about 10 units of ethylene oxide per molecule average and wherein the alkyl group contains from about 10 to about 20 carbon atoms.

In addition, suitable anionic surfactants include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Water-soluble nonionic surfactants are also useful in the instant invention. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched chain configuration, with from about 3 to 12 moles of ethylene oxide per mole of alkyl phenol. Included are the water-soluble and water-dispersible condensation products of aliphatic alcohols containing from 8 to 22 carbon atoms, in either straight chain or branched configuration, with from 3 to 12 moles of ethylene oxide per mole of alcohol.

An additional group of nonionics suitable for use herein are semi-polar nonionic surfactants which include water-soluble amine oxides containing one alkyl moiety of from about 10 to 18 carbon atoms and two moieties selected from the group of alkyl and hydroxyalkyl moieties of from about 1 to about 3 carbon atoms; water-soluble phosphine oxides containing one alkyl moiety of about 10 to 18 carbon atoms and two moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Preferred nonionic surfactants are of the formula $R^1(OC_2H_4)_nOH$, wherein $R^1$ is a $C_{10}$–$C_{16}$ alkyl group or a $C_8$–$C_{12}$ alkyl phenyl group, and n is from 3 to about 80. Particularly preferred are condensation products of $C_{12}$–$C_{15}$ alcohols with from about 5 to about 20 moles of ethylene oxide per mole of alcohol, e.g., $C_{12}$–$C_{13}$ alcohol condensed with about 6.5 moles of ethylene oxide per mole of alcohol.

Additional suitable nonionic surfactants include polyhydroxy fatty acid amides of the formula

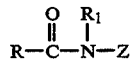

wherein R is a $C_{9-17}$ alkyl or alkenyl, $R_1$ is a methyl group and Z is glycityl derived from a reduced sugar or alkoxylated derivative thereof. Examples are N-methyl N-1-deoxyglucityl cocoamide and N-methyl N-1-deoxyglucityl oleamide. Processes for making polyhydroxy fatty acid amides are known and can be found in Wilson, U.S. Pat. No. 2,965,576 and Schwartz, U.S. Pat. No. 2,703,798, the disclosures of which are incorporated herein by reference.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic, quaternary, ammonium, phosphonium, and sulfonium compounds in which one of the aliphatic substituents contains from about 8 to 18 carbon atoms.

Cationic surfactants can also be included in the present invention. Cationic surfactants comprise a wide variety of compounds characterized by one or more organic hydrophobic groups in the cation and generally by a quaternary nitrogen associated with an acid radical. Pentavalent nitrogen ring compounds are also considered quaternary nitrogen compounds. Suitable anions are halides, methyl sulfate and hydroxide. Tertiary amines can have characteristics similar to cationic surfactants at washing solution pH values less than about 8.5. A more complete disclosure of these and other cationic surfactants useful herein can be found in U.S. Pat. No. 4,228,044, Cambre, issued Oct. 14, 1980, incorporated herein by reference.

Cationic surfactants are often used in detergent compositions to provide fabric softening and/or antistatic benefits. Antistatic agents which provide some softening benefit and which are preferred herein are the quaternary ammonium salts described in U.S. Pat. No. 3,936,537, Baskerville, Jr. et al., issued Feb. 3, 1976, the disclosure of which is incorporated herein by reference.

Detergent Builder

The detergent composition preferably contains a detergent builder. Builders suitable for use herein include silicates, borates, polyhydroxy sulfonates, polyacetates, phosphates and nonphosphorous, inorganic builders. Examples of nonphosphorus, inorganic builders are sodium and potassium carbonate, bicarbonate, sesquicarbonate, tetraborate decahydrate, and silicates having a weight ratio of $SiO_2$ to alkali metal oxide of from about 0.5 to about 4.0, preferably from about 1.0 to about 2.4. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid. A nonlimiting example of a phosphate builder is sodium tripolyphosphate (STP).

Other suitable polycarboxylates for use herein are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a detergent composition. Particularly preferred polycarboxylate builders are the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Water-soluble silicate solids represented by the formula $SiO_2$, $M_2O$. M being an alkali metal, and having a $SiO_2$:$M_2O$ weight ratio of from about 0.5 to about 4.0, are useful salts in the detergent granules of the invention at levels of from about 2% to about 15% on an anhydrous weight basis, preferably from about 3% to about 8%. Anhydrous or hydrated particulate silicate can be utilized herein, as well. Aluminosilicates including zeolites are suitable for use herein and are more fully discussed in Corkill et al, U.S. Pat. No. 4,605,509, the disclosure of which is incorporated herein by reference. Also, crystalline layered silicates such as those discussed in Corkill et al, U.S. Pat. No. 4,605,509, incorporated herein by reference, are suitable for use in the detergent composition of the invention.

Optional Detergent Ingredients

The detergent composition of the present invention can also include any number of additional ingredients. These include other detergency builders, suds boosters or suds suppressers, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., the disclosure of which is incorporated herein by reference.

Additionally, dye transfer inhibiting agents may also be included, for example, polyvinylpyrrolidone, polyamine N-oxide, copolymers of N-vinylpyrrolidone and N-vinylimidazole are a suitable dye transfer inhibiting polymers for use in the present detergent composition. The level of such additional dye transfer inhibiting agents may vary, but typically will be from about 0.01% to about 10% by weight of the detergent composition.

Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. Nos. 3,933,672, issued Jan. 20, 1976 to Bartoletta et al., and 4,136,045, issued Jan. 23, 1979 to Gault et al., both incorporated herein by reference. Suitable smectite clays for use herein are described in U.S. Pat. No. 4,762,645, Tucker et al, issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al, issued May 5, 1987, both incorporated herein by reference.

While not essential to the detergent composition of the invention, it is preferable to include an enzyme. Suitable enzyme components are available from a wide variety of commercial sources. For example, suitable enzymes are available from NOVO Industries under product names T-Granulate TM and Savinase TM, and Gist-Brocades under product names Maxacal TM and Maxatase TM. Included within the group of enzymes are proteases, amylases, lipases, cellulases and mixtures thereof.

The enzyme level preferably should be from about 0% to about 5%, more preferably from about 0.1% to about 2.5%, and most preferably from about 0.2% to about 1%. Typically, proteases are used at an Activity Unit (Anson Unit) level of from about 0.001 to about 0.05, most preferably from about 0.002 to about 0.02, while amylases are used at an amylase unit level of from about 5 to about 5000, most preferably from about 50 to about 500 per gram of detergent composition.

In order to make the present invention more readily understood, reference is made to the following examples, which are intended to be illustrative only and not intended to be limiting in scope.

EXAMPLE I

This Example illustrates the process of the invention which produces free flowing, crisp, high density detergent agglomerates. Several feed streams of various detergent starting ingredients are continuously fed, at a rate of 1300 kg/hr, into a LodigeKM TM (Ploughshare) 600 mixer/densifier, which is a horizontally-positioned moderate speed mixer/densifier. The rotational speed of the shaft in the mixer/densifier is about 100 rpm and the rotational speed of the cutters is about 3600 rpm. In this Example, all of the feed streams are in the form of dry particles and an agglomerating agent, water, is separately added to facilitate agglomeration. The relative proportion of each starting detergent ingredient in the total feed stream fed into the mixer/densifier (the phrase "total feed stream" meaning the aggregate of all the individual feed streams being fed into the mixer/densifier) is presented in Table I below:

TABLE I

| Component | % Weight of Total Feed |
|---|---|
| LAS/$C_{10-18}$linear alkylbenzene sulfonate | 15.6 |
| AS/$C_{12-16}$alkyl sulfate | 15.6 |

TABLE I-continued

| Component | % Weight of Total Feed |
|---|---|
| Aluminosilicate | 36.8 |
| Sodium carbonate | 18.7 |
| Polyethylene glycol (MW 4000) | 2.0 |
| Misc. (water, perfume, etc.) | 11.3 |
| | 100.0 |

The starting detergent ingredients are continuously passed through the Lodige KM TM (Ploughshare) 600 mixer/densifier, wherein their mean residence time in the mixer/densifier is about 2–3 minutes. The water agglomerating agent is continuously fed into the Lodige KM TM 600 mixer/densifier to aid in the agglomeration process. The agglomerates from the mixer/densifier are dried in a conventional fluidized bed dryer after they exit the Lodige KM TM 600 mixer/densifier to obtain the high density granular detergent agglomerates produced by the process. The density of the resulting detergent agglomerates is about 800 g/l and the mean particle size is 650 microns.

EXAMPLE II

This Example illustrates another embodiment of the process of the invention which also produces free flowing, crisp, high density detergent agglomerates. As with Example I, several feed streams of various detergent starting ingredients are continuously fed, at a rate of 1300 kg/hr, into a Lodige KM TM (Ploughshare) 600 mixer/densifier, which is a horizontally-positioned moderate speed mixer/densifier. The rotational speed of the shaft in the mixer/densifier is about 100 rpm and the rotational speed of the cutters is about 3600 rpm. In this Example, one of the surfactant feed streams ($C_{12-16}$ alkyl sulfate) is in the form of an aqueous paste and the other surfactant feed stream is in the form of dry particles. Additional agglomerating agents are not needed since the water in the surfactant feed stream facilitates agglomeration sufficiently. The relative proportion of each starting detergent ingredient in the total feed stream fed into the mixer/densifier (the phrase "total feed stream" meaning the aggregate of all the individual feed streams being fed into the mixer/densifier) is presented in Table II below:

TABLE II

| Component | % Weight of Total Feed |
|---|---|
| LAS/$C_{10-18}$linear alkylbenzene sulfonate | 14.8 |
| AS/$C_{12-16}$alkyl sulfate | 19.8 |
| Aluminosilicate | 34.9 |
| Sodium carbonate | 17.8 |
| Polyethylene glycol (MW 4000) | 2.0 |
| Misc. (water, perfume, etc.) | 10.7 |
| | 100.0 |

The starting detergent ingredients are continuously passed through the Lodige KM TM (Ploughshare) 600 mixer/densifier wherein their mean residence time in the mixer/densifier is about 2–3 minutes. The agglomerates from the mixer/densifier are dried in a conventional fluidized bed dryer after they exit the mixer/densifier. The density of the resulting detergent agglomerates is about 800 g/l and the mean particle size is 650 microns.

EXAMPLE III

This Example illustrates another embodiment of the process of the invention which also produces free flowing, crisp, high density detergent agglomerates. As with Example I, several feed streams of various detergent starting ingredients are continuously fed, at a rate of 1300 kg/hr, into a Lodige KM TM (Ploughshare) 600 mixer/densifier, which is a horizontally-positioned moderate speed mixer/densifier. The rotational speed of the shaft in the mixer/densifier is about 100 rpm and the rotational speed of the cutters is about 3600 rpm. In this Example, both of the anionic surfactant feed streams are in the form of an aqueous paste. Additional agglomerating agents are not needed since the water in the anionic surfactant feed streams facilitates agglomeration sufficiently. The relative proportion of each starting detergent ingredient in the total feed stream fed into the mixer/densifier (the phrase "total feed stream" meaning the aggregate of all the individual feed streams being fed into the mixer/densifier) is presented in Table III below:

TABLE III

| Component | % Weight of Total Feed |
|---|---|
| LAS/$C_{10-18}$linear alkylbenzene sulfonate | 19.5 |
| AS/$C_{12-16}$alkyl sulfate | 19.5 |
| Aluminosilicate | 34.4 |
| Sodium carbonate | 17.5 |
| Misc. (water, perfume, etc.) | 9.2 |
| | 100.0 |

As with the previous Examples, the starting detergent ingredients are continuously passed through the Lodige KM TM (Ploughshare) 600 mixer/densifier wherein their mean residence time in the mixer/densifier is about 2–3 minutes. The agglomerates from the mixer/densifier are dried in a conventional fluidized bed dryer after they exit the Lodige KM TM 600 mixer/densifier. The density of the resulting detergent agglomerates is about 800 g/l and the mean particle size is 650 microns.

Having thus described the invention in detail, it will be obvious to those skilled in the art that various changes may be made without departing from the scope of the invention and the invention is not to be considered limited to what is described in the specification.

What is claimed is:

1. A process for producing a high density detergent composition having a density of 650 g/l comprising the steps of:

(a) forming detergent agglomerates by feeding in a mixer/densfier (i) from about 1% to about 50% by weight of a $C_{10-18}$ linear alkylbenzene sulfonate surfactant, (ii) from about 1% to about 50% by weight of a $C_{12-16}$ alkyl sulfate surfactant in a separate feed stream from said linear alkylbenzene sulfonate, wherein said linear alkylbenzene sulfonate and said alkyl sulfate are in the form of dry particles, (iii) from about 20% to about 50% by weight of a builder, and (iv) from about 0.1% to about 35% by weight of an agglomerating agent, polyethylene glycol, which substantially prevents the intimate mixing of said linear alkylbenzene sulfonate surfactant and said alkyl sulfate surfactant in said mixer/-densifier; and (b) drying said detergent agglomerates to form said high density detergent composition having a density of 650 g/l.

2. A process according to claim 1 wherein the weight ratio of said linear alkylbenzene sulfonate surfactant to said alkyl sulfate surfactant is from about 1:10 to about 10:1.

3. A process according to claim 1 wherein said builder is selected from the group consisting of silicates, borates, polyhydroxy sulfonates, polyacetates, phosphates, carbonates, bicarbonates, sesquicarbonates, tetraborate decahydrates, carboxylates, polycarboxylates and mixtures thereof.

4. A process according to claim 1 further comprising an adjunct surfactant selected from the group consisting nonionics, zwitterionics, ampholytics, cationics and mixtures thereof.

* * * * *